US005922395A

United States Patent [19]

Koike et al.

[11] Patent Number: 5,922,395

[45] Date of Patent: Jul. 13, 1999

[54] METHOD FOR FORMING PHOSPHOR SCREEN

[75] Inventors: Norio Koike, Fukaya; Yoshinori Takahashi, Saitama-ken, both of Japan

[73] Assignee: Kabushiki Kaisha Toshiba, Japan

[21] Appl. No.: 08/907,897

[22] Filed: Aug. 11, 1997

[30] Foreign Application Priority Data

Aug. 15, 1996 [JP] Japan ..... 8-215650

[51] Int. Cl.[6] ..... B05D 5/06

[52] U.S. Cl. ..... 427/68; 427/64; 427/162; 427/419.2; 427/419.3

[58] Field of Search ..... 427/64, 68, 419.2, 427/162

[56] References Cited

U.S. PATENT DOCUMENTS

| | | | |
|---|---|---|---|
| 3,884,694 | 5/1975 | Gallaro et al. . | |
| 3,884,695 | 5/1975 | Gallaro et al. . | |
| 4,973,495 | 11/1990 | Koike et al. | 427/68 |
| 5,340,673 | 8/1994 | Tateyama et al. | 430/23 |
| 5,369,331 | 11/1994 | Mizukami et al. | 427/68 |

FOREIGN PATENT DOCUMENTS

| | | |
|---|---|---|
| 53-69577 | 6/1978 | Japan . |
| 3-261044 | 11/1991 | Japan . |
| 8-87962 | 4/1996 | Japan . |
| 8-171854 | 7/1996 | Japan . |
| 8-185799 | 7/1996 | Japan . |

*Primary Examiner*—Janyce Bell
*Attorney, Agent, or Firm*—Finnegan, Henderson, Farabow, Garrett & Dunner, L.L.P.

[57] ABSTRACT

A dispersion solution of colloidal silica is coated on a pigment layer composing a filter layer and then dried. Thus, the state of the front surface of the filter layer (pigment layer) is controlled without affecting the filter layer (pigment layer). A phosphor layer is formed on the filter layer (pigment layer).

12 Claims, 4 Drawing Sheets

METHOD FOR FORMING PHOSPHOR SCREEN

BACKGROUND OF THE INVENTION

1. Field of the Invention

The present invention relates to a method for forming a phosphor screen used for display units such as cathode ray tubes and plasma display panels (PDP).

2. Description of the Related Art

Conventionally, dot shaped or stripe shaped phosphor layers containing phosphors that emit light of blue, green, and red are formed on the inner surface of a face plate of a color cathode ray tube. In the color cathode ray tube, an electron beam strikes the phosphor layers and thereby the phosphors emit light of blue, green, and red. Thus, the color cathode ray tube displays a picture. In the color cathode ray tube, filter layers corresponding to colors that phosphors emit are disposed on the front surface of the phosphor layers (namely, between the inner surface of the face plate and the phosphor layers). The filter layers are structured by forming pigment layers in a predetermined pattern between the face panel and the phosphor layers. The pigment layers contain pigments corresponding to respective colors and transmit light with almost the same wave lengths of the light of colors of the phosphor layers. Green and blue components of incident light are absorbed by a red pigment layer. Green and red components of incident light are absorbed by a blue pigment layer. Blue and red components of incident light are absorbed by a green pigment layer. Thus, characteristics of such as contrast and color impurity of a picture are improved.

Conventionally, the filter layers are formed by coating pigment layers on the inner surface of the face plate and performing an exposing step and a developing step so as to pattern the pigment layers. At this point, on the inner surface of the face plate, the pigment layers should have adhesion in an area for which they are left as a pattern of the filter layers. In addition, the pigment layers should have peel-off property in an area from which they are removed. Moreover, since the pigment layers should have transparency, the particles of the pigments should be equally dispersed, not cohered. Phosphor layers with colors corresponding to individual pigment layers are formed on the filter layers by slurry method or the like.

However, in such a forming method of the phosphor layers, phosphors with difference colors reside in the filter layers (pigment layers). For example, when a blue phosphor layer is formed by the slurry method, the blue phosphor resides in the green and red filter layers. Thereafter, when a green phosphor layer is formed, green phosphor resides in the red filter layer. Thus, the uniformity property of a color cathode ray tube deteriorates.

Although the reason of which phosphor resides in the filter layers is not clear, the following reason can be supposed. Pigment particles that compose the filter layers are metal oxide. In addition, when the filter layers are formed, a high molecular compound (resin) is added. Thus, static electric force works between silica used for the surface treatment of the phosphor and the filter layers. The static electric force causes the phosphor to reside in the filter layers. Generally, since silica is negatively charged, it is supposed that the filter layers are positively charged.

To form the phosphor layers, slurry method is normally used. As a photoresist, a mixture of ammonium dichromate and a solution of polyvinyl alcohol is used. As an exposure light source, an ultra-high-voltage mercury lamp is used. However, the pigments that compose the filter layers have an optical absorption in a band with a wave length of around 365 nm where the pigments optically link with the photoresist. Thus, when the photoresist is exposed, the sensitivity becomes insufficient. In particular, the exposure sensitivity of the photoresist that contacts the filter layers decreases. Thus, after the phosphor layers are developed, phosphor drop out thereof.

The present invention is made from the above-described point of view. An object of the present invention is to provide a method for forming a phosphor screen, the method preventing part of phosphor layers and/or phosphor contained therein from residing in the filter layers when the phosphor layers are removed from the filter layers.

Another object of the present invention is to provide a method for forming a phosphor screen, the method almost preventing phosphor from dropping out of the filter layers after the phosphor layers are developed.

A further object of the present invention is to provide a method for forming a phosphor screen that contributes to displaying a picture with high brightness and high contrast, the method almost preventing the uniformity property of a color cathode ray tube or the like from deteriorating.

SUMMARY OF THE INVENTION

A first aspect of the present invention is a method for forming a phosphor screen, comprising the steps of forming a pigment layer on a substrate, the pigment layer containing a pigment and transmitting light with a predetermined wave length, controlling electric charge on the front surface of the pigment layer and light absorption on the front surface thereof, and coating with a phosphor layer containing phosphor the front surface of the pigment layer of which the electric charge and the light absorption have been controlled.

A second aspect of the present invention is a method for forming a phosphor screen, comprising the steps of forming a pigment layer on a substrate, the pigment layer containing a pigment and transmitting light with a predetermined wave length, forming a silica layer containing silica on the pigment layer, and coating the silica layer with a phosphor layer containing phosphor.

A third aspect of the present invention is a method for forming a phosphor screen, comprising the steps of forming a first pigment layer and a second pigment layer in a first area and a second area of a substrate, respectively, the first pigment layer containing a first pigment and transmitting light with a first wave length, the second pigment layer containing a second pigment and transmitting light with a second wave length, forming a first silica layer and a second silica layer on the first pigment layer and the second pigment layer, respectively, the first silica layer and the second silica layer each containing silica, coating the first silica layer with a first phosphor layer containing a first phosphor, and coating the second silica layer with a second phosphor layer containing a second phosphor.

In the method for forming a phosphor screen according to the present invention, the electric charge on the front surface of the pigment layers can be properly controlled corresponding to the application and so forth thereof. For example, when the phosphor layers are removed from the filter layers that are composed of the pigment layers, by causing the front surface of the pigment layers to be negatively charged, part of the phosphor layers and/or phosphor particles contained therein are suppressed from residing in the filter layers. This is because the phosphor layers have been negatively charged as will be described later. The optical absorption on the front surface of the pigment layers can be properly controlled corresponding to the purpose and so forth of the present invention. For example, when the phosphor layers coated on the pigment layers are developed, the optical absorption of the phosphor layers is controlled so that light in a band with a wave length of around 365 nm where the pigments optically link with the photoresist are not absorbed on the front surface of the pigment layers and the photoresist is prevented from being insufficiently exposed. The method for controlling the electric charge on the front surface of the pigment layers and the absorption of the light on the front surface of the pigment layers are not limited as long as the characteristics of the phosphor screen are not deteriorated.

According to the present invention, as pigments, both organic pigments and inorganic pigments can be used. In particular, pigments that can be equally dispersed in the filter layers and that have transparency allowing the filter layers to sufficiently transmit light free of scattering are preferably used. In the fabrication process of a color cathode ray tube, since the pigments are exposed to a high temperature environment, inorganic pigments are preferably used. Real examples of pigments that have such characteristics are as follows.

Examples of the red pigment are (Sicotrans Red) L-2817 (particle diameter=0.01 $\mu$m to 0.02 $\mu$m: BASF Company) that is a pigment of ferric oxide and (Cromophthal Red) A2B (particle diameter=0.01 $\mu$m: (Chiba Geigy Co., Ltd.)) that is a pigment of anthraquinone. Examples of the blue pigment are cobalt blue X (particle diameter=0.01 $\mu$m to 0.02 $\mu$m: (Toyo-Ganryo Inc.)) that is a pigment of cobalt aluminate ($Al_2O_3$—CoO), ultramarine No. 8000 (particle diameter=0.03 $\mu$m: (Daiichi Kasei Inc.)) that is a pigment of ultramarine, and (Lionol Blue) FG-7370 (particle diameter=0.01 $\mu$m: (Toyo Ink)) that is a pigment of phthalocyanine blue. Examples of the green pigment are (Dypyroxide) TM-green #3320 (particle diameter=0.01 $\mu$m to 0.02 $\mu$m: (Dainichiseika Inc.)) that is a pigment of $TiO_2$—NiO—CoO—ZnO, (Dypyroxide) TM-green #3420 (particle diameter=0.01 $\mu$m to 0.02 $\mu$m: (Dainichiseika Inc.)) that is a pigment of CoO—$Al_2O_3$—$Cr_2O_3$, ND-801 (particle diameter=0.35 $\mu$m: (Nihon Denko Inc.)) that is a pigment of $Cr_2O_3$, (Fastogen Green) (particle diameter=0.01 $\mu$m: (Dainippon Ink)) that is a pigment of chlorinated phthalocyanine green, and (Fastogen Green) 2YK (particle diameter=0.01 $\mu$m: (Dainippon Ink)) that is a pigment of brominated phthalocyanine green.

According to the present invention, the filter layers composed of such pigment layers are formed in the following manner as disclosed in for example Japanese Patent Laid-Open Application No. 8-171854.

A pigment dispersion solution of pigment particles and a dispersion agent composed of high molecular electrolyte is coated on the inner surface of a face plate having a black matrix by for example spin coat method, roller method, or dipping method. The coating method can be properly selected corresponding to the shape, the size, and so forth of a substrate such as the face plate. In particular, to obtain a predetermined equal film thickness, the spin coat method is preferably used. After the pigment dispersion solution is coated on the substrate, the coated film is dried. The drying method is not limited as long as moisture of the film is evaporated and part of salt of the high molecular electrolyte is dissociated. Thus, various methods using a heater or dried wind can be used. Alternatively, the coated film may be dried by leaving it in a room temperature environment for a long time.

When the pigment layer is patterned, a photoresist has been contained in the pigment dispersion solution. Examples of the photoresist are ammonium dichromate (ADC)/polyvinyl alcohol (PVA), sodium dichromate (SDC)/PVA, and diazonium salt/PVA. When the pigment layer containing the photoresist is formed on the substrate, light (ultraviolet rays) emitted from a ultra-high-voltage mercury lamp causes the pigment layer to harden. Thereafter, when the pigment layer is developed with an alkali solution containing a substance that dissolves the high molecular electrolyte that is dissolvable with water, a filter layer can be formed in a predetermined pattern. Alternatively, after a pigment layer is formed on a substrate (in this case, a pigment dispersion solution does not contain a photoresist), a photoresist layer is formed on the pigment layer. Thereafter, when the pigment layer is exposed and developed, it can be patterned. In this case, the photosensitive characteristics of the photoresist is improved. In other words, the exposure time of the photoresist becomes short. The adhesion of the substrate and the pigment layer is improved. In addition, the thickness of the filter layer can be increased.

By repeating such a process a plurality of number of times for pigment dispersion solutions containing blue pigment, green pigment, and red pigment, color filter layers composed of three color pigment layers of blue, green, and red can be formed.

According to the present invention, after filter layers are formed in a predetermined pattern, a colloidal silica solution is coated on the filter layers and then dried. Thus, a silica layer is formed. Thereafter, blue, green, and red phosphor layers are formed on the silica layer by the slurry method.

The particle diameter of the colloidal silica is preferably 15 nm or less. The colloidal silica solution is preferably adjusted at a pH of 2.0 to 5.0. When the particle diameter of the colloidal silica exceeds 15 nm, the phosphor residual in the filter layer cannot be suppressed. When the pH of the colloidal silica solution is less than 2.0, silica tends to cohere in the solution. In contrast, when the pH of the solution exceeds 5.0, as with the case of which the ph of the colloidal silica is low, silica tends to cohere in the solution. Thus, the filter layers may be excessively developed.

In addition, the content of silica in the colloidal silica solution is preferably in the range from 0.2 to 5.0% by weight, more preferably, in the range from 0.8 to 3.0% by weight. When the content of silica in the colloidal silica solution is smaller than 0.2% by weight, the phosphor residual cannot be suppressed when the colloidal silica solution is coated and dried. In addition, the adhesion of the filter layer and the fluorescent layer deteriorates. In contrast, when the content of silica in the colloidal silica solution exceeds 5.0% by weight, although the adhesion of the filter layer and the phosphor layer improves, the phosphor residual in the filter layer tends to increase.

Table 1 shows the relation among the content of silica in the colloidal silica solution coated on the filter layers, the residual level of the green phosphor in the red filter layer (number of points), and the adhesion (adhesive force) of the blue phosphor in the blue filter layer. The residual levels were measured by counting the number of points of phosphor whose particle diameter is 5 $\mu$m or more in 0.12 mm$\phi$. When the number of residual points exceeds 20, the white uniformity property of the cathode ray tube is adversely deteriorated.

TABLE 1

| Content of silica | Residual level of green phosphor | Adhesion of blue phosphor |
|---|---|---|
| 0.2% by weight | 15 to 20 points | Several drop-outs of phosphor |
| 0.8% by weight | 5 to 15 points | No drop-out of phosphor |
| 1.5% by weight | 1 to 3 points | No drop-out of phosphor |
| 3.0% by weight | 5 to 10 points | No drop-out of phosphor |
| 6.0% by weight | 30 points or more | No drop-out of phosphor |

Table 1 shows that the concentration of the colloidal silica solution coated on the filter layers is preferably in the range from 0.2 to 5.0% by weight, more preferably, in the range from 0.8 to 3.0% by weight.

According to the present invention, since a dispersion solution of colloidal silica is coated on the pigment layers with individual colors composing the filter layers and then dried, the front surface of the filter layers can be negatively charged free of a damage of the filter layers (pigment layers). Thus, electric repulsive force takes place between the front surface of the filter layers that are negatively charged and silica used for the surface treatment of the phosphors. Thus, the phosphors are almost prevented from residing in the filter layers. In addition, since the silica layer are formed on the filter layers, when the phosphor layers are developed, the exposure sensitivity of the photoresist can be prevented from deteriorating. Thus, after the phosphor layers are developed, the phosphor can be almost prevented from dropping out of the filter layers. In addition, the silica layer formed by coating and drying the colloidal silica solution functions as an adhesive agent. Thus, the adhesion between the filter layers and the phosphor layers is improved. Consequently, after the phosphor layers are developed, the phosphors can be prevented from dropping out of the filter layers. In addition, since silica that composes the silica layers penetrate a fine space portion of the filter layer, the adhesive force between the filter layers and the substrate such as a glass panel is improved.

Thus, when the method for forming a phosphor screen according to the present invention is applied, a color cathode ray tube with high contrast and high brightness can be obtained without deterioration of the uniformity property of the phosphor screen thereof.

These and other objects, features and advantages of the present invention will become more apparent in light of the following detailed description of best mode embodiments thereof, as illustrated in the accompanying drawings.

DESCRIPTION OF PREFERRED EMBODIMENTS

Next, with reference to the accompanying drawings, preferred embodiments of the present invention will be described.

First Embodiment

Figure 1:
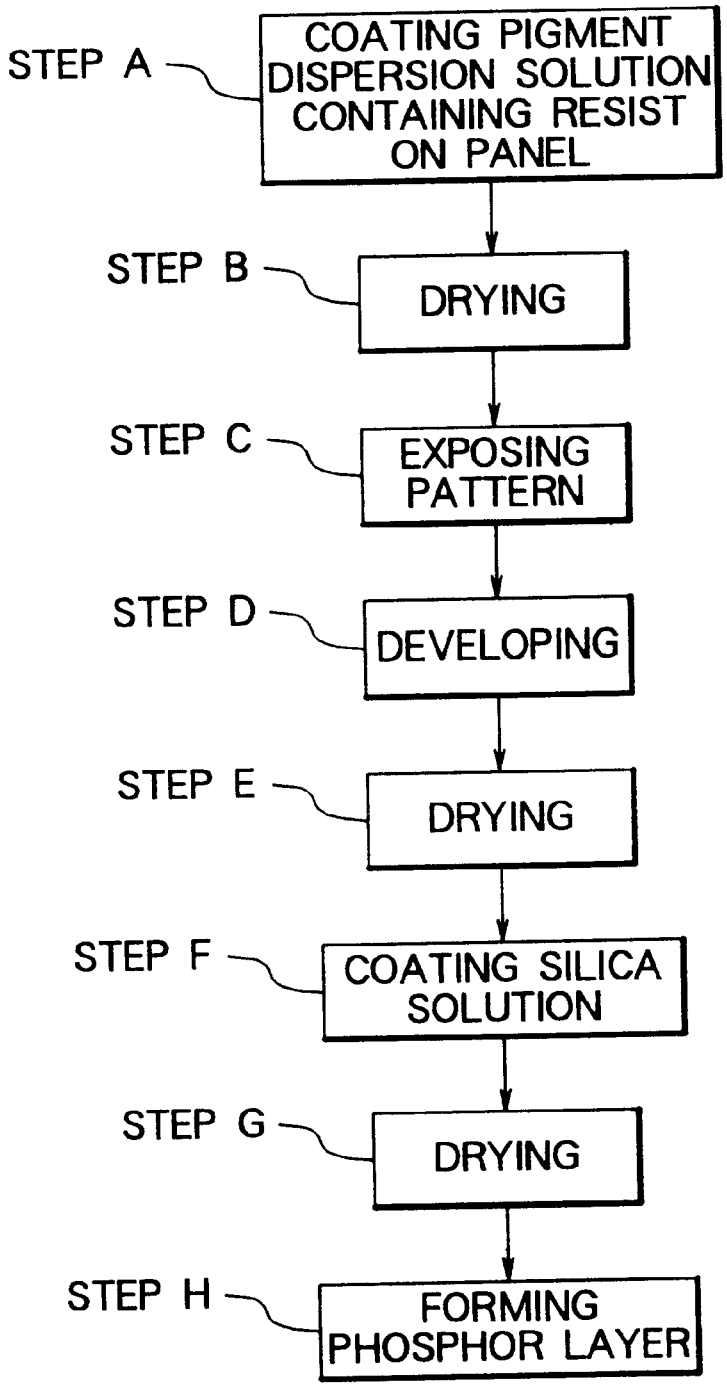
FIG. 1 is a schematic diagram showing steps of a process for forming a phosphor screen according to a first embodiment of the present invention.

FIG. 1 is a schematic diagram showing steps of a process of a method for forming a phosphor screen according to a first embodiment of the present invention. FIGS. 2A to 2F are sectional views showing states of the panel at the steps of the process according to the first embodiment. In the first embodiment, at steps A to E shown in FIG. 1, a blue (or green) filter layer is formed. By repeating steps A to E, a green (or blue) filter layer and a red filter layer are successively formed. After colloidal silica solution are coated and dried at steps F and H, a phosphor layer is formed in a predetermined pattern at step H.

Figure 2A:
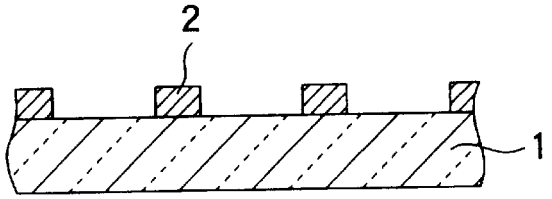
FIG. 2A, FIG. 2B, FIG. 2C, FIG. 2D, FIG. 2E, and FIG. 2F are sectional views showing states of a panel at individual steps of the process according to the first embodiment of the present invention.

As shown in FIG. 2A, a light absorbing layer 2 that functions as a black matrix was formed on the inner surface of a face plate 1 for a color cathode ray tube by a known method. In other words, a resist was coated on the inner surface of the face plate 1 and then exposed through a shadow mask. Thereafter, a developing step and a drying step were performed. Thus, a stripe shaped or dot shaped light hardening film was left at an area for a pigment layer and a phosphor layer. Thereafter, a light absorbing substance such as graphite was coated and cohered on the inner surface of the face plate 1 with the light hardening film left. Thereafter, the light hardening film was rinsed with hydrogen peroxide and dissolved. Thus, the light absorbing substance was removed from the light hardening film. A hole portion for the pigment layer and the phosphor layer was exposed and the light absorbing layer 2 was patterned.

Next, pigment dispersion solutions with the following compositions were prepared for forming filter layers of blue, green, and red.

A blue pigment dispersion solution was obtained by dispersing 30% by weight of cobalt blue X as blue pigment particles, 0.5% by weight of PVA containing ADC as a photoresist, and 0.7% by weight of ammonium salt of polyacrylate copolymer ((Dispeck) GA-40: (Allied Colloid Co.)) in pure water. At that point, the weight ratio of the high molecular electrolyte and the pigment (high molecular electrolyte/pigment) was 0.023, the weight ratio of the resist and the high molecular electrolyte (resist/high molecular electrolyte) was 0.714, and the weight ratio of the resist and the pigment (resist/pigment) was 0.017.

A green pigment dispersion solution was obtained by dispersing 30% by weight of (Dypyroxide) TM green #3320 as green pigment particles, 2% by weight of ADC/PVA as a photoresist, and 0.7% by weight of sodium salt of acrylic acid ((Dispeck) N-40: (Allied Colloid Co.)) as high molecular electrolyte in pure water. At that point, the weight ratio of the high molecular electrolyte and the pigment (high molecular electrolyte/pigment) was 0.023, the weight ratio of the resist and the high molecular electrolyte (resist/high molecular electrolyte) was 2.857, and the weight ratio of the resist and the pigment (resist/pigment) was 0.067.

A red pigment dispersion solution was obtained by dispersing 30% by weight of fine particles of $Fe_2O_3$ (particle diameter=0.01 $\mu$m to 0.02 $\mu$m) as red pigment particles, 2% by weight of ADC/PVA as a photoresist, and 0.7% by weight of ammonium salt of polyoxyethylene alkylethersulfate ((Hitenor 08): (Dai-ichi Kogyoseiyaku Co., Ltd.)) in pure water. At that point, the weight ratio of the high molecular electrolyte and the pigment (high molecular electrolyte/pigment) was 0.023, the weight ratio of the resist and the high molecular electrolyte (resist/high molecular electrolyte) was 2.857, and the weight ratio of the resist and the pigment (resist/pigment) was 0.067.

Figure 2B:
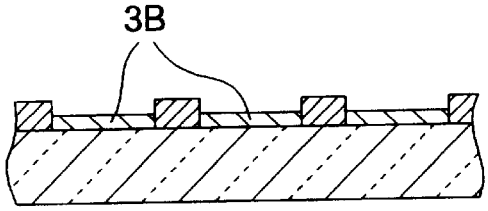

The pigment dispersion solutions were coated and dried at steps A and B in the following manner. The temperature of the face plate 1 (for the color cathode ray tube) as the substrate was maintained at 30° C. First, the blue pigment dispersion solution was coated on the face plate 1. Thereafter, the face plate 1 was rotated at 100 to 150 rpm so as to remove excessive pigment dispersion solution. Thus, a coated layer with a predetermined thickness was obtained. Next, the coated film was dried at a temperature of 120° C. for 3 to 4 minutes. Thus, as shown in FIG. 2B, a blue pigment coated layer 3B was formed.

Figure 2C:
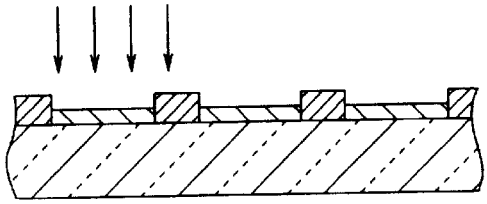

Thereafter, as shown in FIG. 2C, the blue pigment coated layer 3B was exposed in a predetermined pattern through a shadow mask (not shown) at step C. As the light source, a high-voltage mercury lamp was used.

Figure 2D:
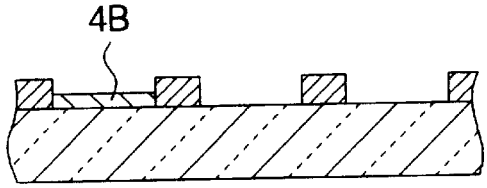

Next, a developing solution (for example, an alkali solution at a pH of 9 containing NaOH) was sprayed to the blue pigment coated layer 3B at a pressure of 2 to 10 kg/cm$^2$ so as to develop the blue pigment coated layer 3B. Thus, as shown in FIG. 2D, a blue pigment layer 4B with a predetermined pattern was formed.

Next, in the same manner as the forming step for the blue pigment layer 4B, a green pigment layer 4G and a red pigment layer 4R were successively formed. At that point, as a developing solution for the green pigment coated layer and the red pigment coated layer, an alkali solution containing LiCl was used.

Figure 2E:
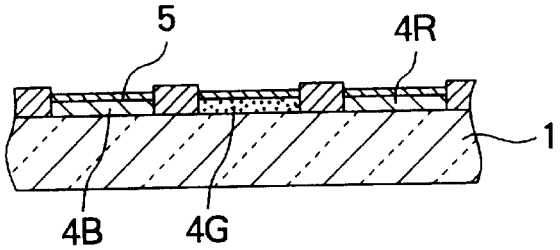

As shown in FIG. 2E, after filter layers composed of the blue pigment layer 4B, the green pigment layer 4G, and the red pigment layer 4R were formed on the inner surface of the face plate 1, a colloidal silica solution at a pH of 3.5 to 4.0 and with the following composition was coated on the entire surface of the filter layers at step F. Thereafter, the coated solution was dried at step G. Thus, a silica layer 5 was formed. The pH of the colloidal silica solution was adjusted to the acid side. This is because when an alkali solution is coated on the filter layers, they are damaged and the filter layers drop out of the inner surface of the face plate 1.

Colloidal silica solution

Figure 2F:
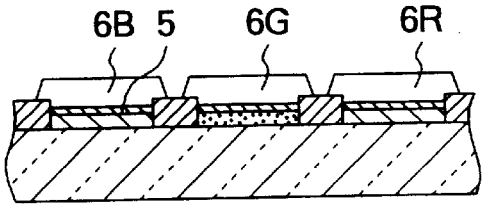

SNOWTEX-OS ((Nissan Chemicals Co., Ltd.): silica particle diameter=8 to 11 nm, solid content ($SiO_2$)= 20.0 to 21.0%) . . . 6.0 kg Pure water . . . 80 litters Next, as shown in FIG. 2F, a blue phosphor layer 6B, a green phosphor layer 6G, and a red phosphor layer 6R were successively formed on the blue pigment layer 4B, the green pigment layer 4G, and the red pigment layer 4R, respectively, by the slurry method.

At that point, the residual levels of the blue phosphor in the areas for the green phosphor layer and the red phosphor layer were measured. The number of points of phosphor whose particle diameter was 5 μm or more was measured in an area of 0.12 mmϕ. Likewise, the residual levels of the blue phosphor were measured in the case that the colloidal silica solution was not coated on the filter layers and the phosphor layers are directly formed on the filter layers (as the first comparison) and in the case that the filter layers were not formed and the phosphor layers were directly formed on the inner surface of the face plate (as the second comparison). Table 2 shows the measured results.

TABLE 2

| | First embodiment | First comparison | Second comparison |
|---|---|---|---|
| Area for green phosphor layer | 1 to 3 points | 20 points or more | 1 to 3 points |
| Area for red phosphor layer | 1 to 3 points | 20 points or more | 1 to 3 points |

In addition, to determine the adhesive force (adhesion) of the phosphors, the limit film thickness of which the individual phosphors with an average particle diameter of 5.5 μm did not drop out of the face places of the first embodiment, the first comparison, and the second comparison was measured. The film thickness was represented as the weight of each coated phosphor in an area of 16 cm$^2$. Table 3 shows the measured results.

TABLE 3

| | First embodiment | First comparison | Second comparison |
|---|---|---|---|
| Amount of coated blue phosphor (mg) | 49 | 38 | 41 |
| Amount of coated green phosphor (mg) | 49 | 37 | 39 |
| Amount of coated red phosphor (mg) | 67 | 46 | 48 |

As clear from Tables 1 and 2, according to the first embodiment, when a phosphor screen with filter layers is formed, the residual levels of phosphors are remarkably improved. In addition, the adhesion of the phosphors is also improved. Thus, a color cathode ray tube with a high contrast, high brightness, and high picture quality can be obtained without deterioration of uniformity property of the phosphor screen.

Second embodiment

Figure 3:
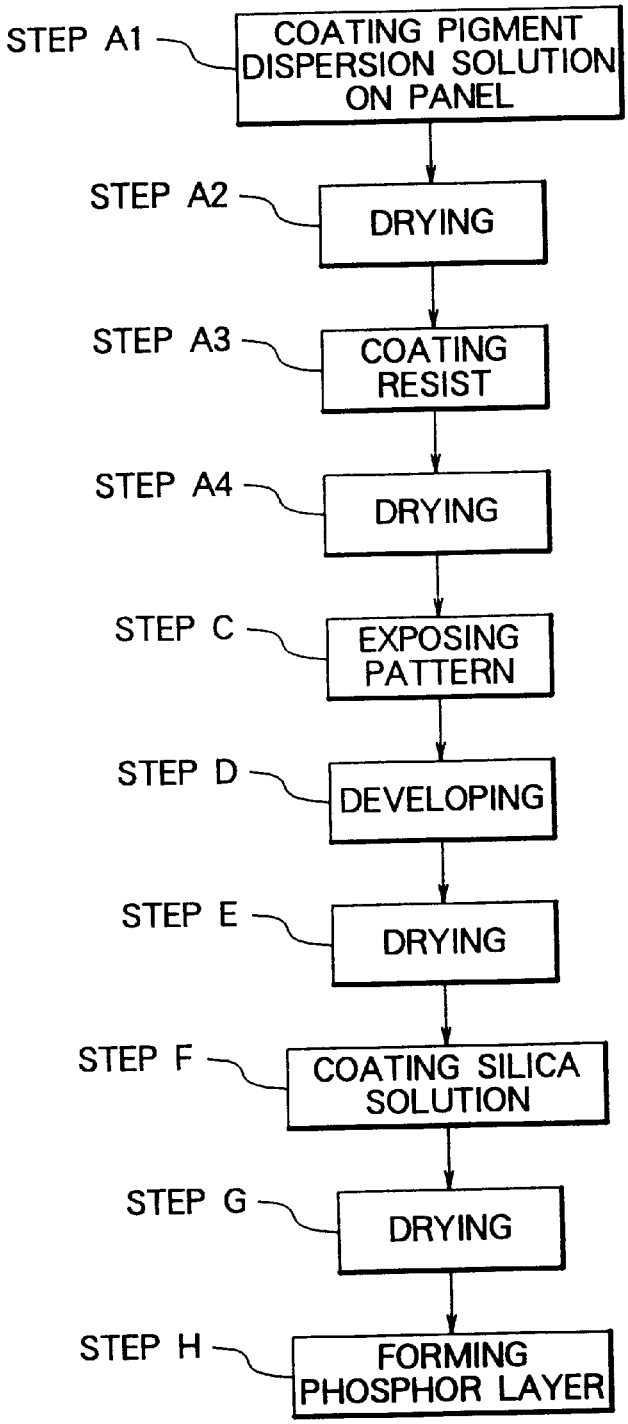
FIG. 3 is a schematic diagram showing steps of a process for forming a phosphor screen according to a second embodiment of the present invention.

Next, with reference to FIGS. 3 and 4, a method for forming a phosphor screen according to a second embodiment of the present invention will be described. FIG. 3 shows steps of the process according to the second embodiment. By repeating steps A1 to A4 and steps C to E shown in FIG. 3, filter patterns of a plurality of colors can be formed.

Figure 4A:
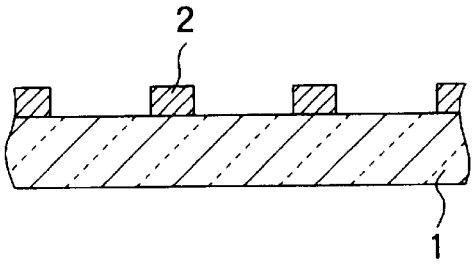
FIG. 4A, FIG. 4B, FIG. 4C, FIG. 4D, FIG. 4E, and FIG. 4F are sectional views showing states of a panel at individual steps of the process according to the second embodiment of the present invention.

First of all, as shown in FIG. 4A, as with the first embodiment, a light absorbing layer 2 that functions as a black matrix was formed on the inner surface of a face plate 1 for a color cathode ray tube. Thereafter, a pigment dispersion solution was coated and dried at steps A1 and A2 in the following manner.

Pigment dispersion solutions with the following compositions were prepared for forming filter layers of blue, green, and red. In the second embodiment, the pigment dispersion solutions do not contain photoresist unlike with those of the first embodiment.

A blue pigment dispersion solution was obtained by dispersing 30% by weight of cobalt blue X as blue pigment particles and 0.7% by weight of (Dispeck) GA-40 as high molecular electrolyte in pure water. At that point, the weight ratio of the high molecular electrolyte and the pigment (high molecular electrolyte/pigment) was 0.023.

A green pigment dispersion solution was obtained by dispersing 30% by weight of (Dypyroxide) TM green #3320 as green pigment particles and 0.7% by weight of (Dispeck) N-40 as high molecular electrolyte in pure water. At that point, the weight ratio of the high molecular electrolyte and the pigment (high molecular electrolyte/pigment) was 0.023.

A red pigment dispersion solution was obtained by dispersing 20% by weight of fine particles (particle diameter= 0.01 μm to 0.02 μm) of $Fe_2O_3$ as red pigment particles and 0.7% by weight of (Hitenor 08) as high molecular electrolyte in pure water. At that point, the weight ratio of the high molecular electrolyte and the pigment (high molecular electrolyte/pigment) was 0.035.

Figure 4B:
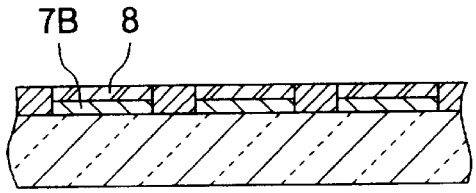

As with the first embodiment, the temperature of a face plate 1 for a color cathode ray tube was maintained at 30° C. First, the blue pigment dispersion solution was coated on the face plate 1. Next, the face plate 1 was rotated at 100 to 150 rpm so as to remove excessive pigment dispersion solution. Thereafter, the pigment dispersion solution was dried at a temperature of 120° C. for 3 to 4 minutes. Thus, as shown in FIG. 4B, a blue pigment layer 7B was formed.

Next, a resist was coated and dried at steps A3 and A4 in the following manner. A photoresist solution with a composition of 3% by weight of PVA, 0.20% by weight of ADC, 0.01% by weight of surface active agent, and pure water (the rest of the content thereof) was prepared. The solution was coated and dried in the same manner as the pigment layer. Thus, as shown in FIG. 4B, a photoresist layer 8 was formed on the blue pigment layer 7B.

Figure 4C:
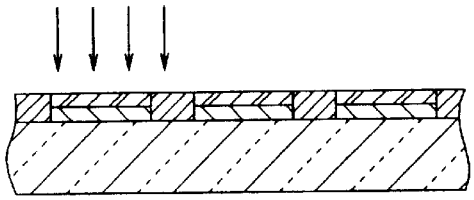

Next, as shown in FIG. 4C, the photo resist layer 8 was exposed in a predetermined pattern through a shadow mask (not shown) at step C. As a light source, a high-voltage mercury lamp was used. In this embodiment, the exposure time was ⅕ of the first embodiment of which the pigment dispersion solutions containing resist were used.

Figure 4D:
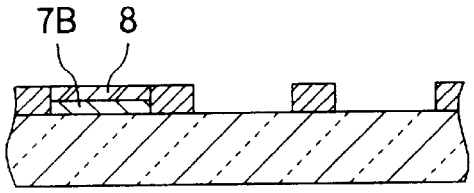

Thereafter, a developing solution (namely, an alkali solution at a pH of around 9 and containing for example $Na_2CO_3$) was sprayed to the photoresist layer 8 at a pressure of 2 to 10 kg/cm$^2$. Thus, the photoresist layer 8 was developed and dried at steps D and E. Thus, as shown in FIG. 4D, the blue pigment layer 7B and the resist layer 8 was patterned.

Next, as with the forming step of the blue pigment layer 7B, a green pigment layer and a red pigment layer were successively formed. At that point, as a developing solution, an alkali solution containing $Na_2CO_3$ was used.

Figure 4E:
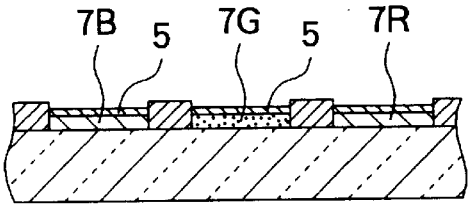

After the filter layers composed of the blue pigment layer 7B, the green pigment layer 7G, and the red pigment layer 7G were formed on the inner surface of the face plate 1, as shown in FIG. 4E, the resist layers 8 were peeled off from the blue, green, and red pigment layers. Next, as with the first embodiment, a colloidal silica solution at a pH of 3.5 to 4.0 was coated on the entire surface of the filter layers at step F. The colloidal silica solution coated on the filter layers was dried and thereby a silica layer 5 was formed at step G.

Figure 4F:
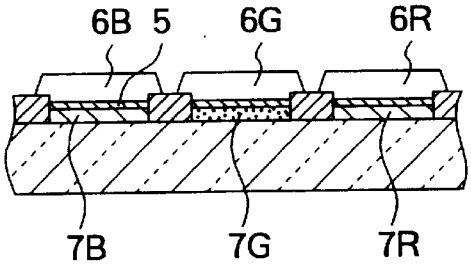

Next, as shown in FIG. 4F, a blue phosphor layer 6B, a green phosphor layer 6G, and a red phosphor layer 6R were successively formed on the blue pigment layer 7B, the green pigment layer 7G, and the red pigment layer 7R, respectively, by the slurry method at step H.

Thus, a phosphor screen with filters of which a blue pigment layer, a green pigment layer, a red pigment layer, and phosphor layers had been formed in a predetermined pattern was obtained. As with the first embodiment, on the phosphor screen with the filters, the residual levels of phosphors on the pigment layers were remarkably improved. In addition, the adhesion of the phosphors was also improved. Thus, a color cathode ray tube with high contrast, high brightness, and high picture quality can be obtained without deterioration of uniformity property of the phosphor screen.

In the first embodiment, when the exposure sensitivity of the pigment dispersion solutions containing resist is improved, the ratio of the resist to the pigments in the pigment dispersion solutions increases. Thus, the transparency of the pigment layers (filter layers) tends to decrease. However, in the second embodiment, since resist layers are separated from the pigment layers, the transparency of the pigment layers is not affected. Thus, the exposure sensitivity can be remarkably improved.

As described above, in the method for forming a phosphor screen according to the present invention, the electric charge and light absorption on the front surface of the pigment layers are controlled. Consequently, when the phosphor layers are removed from the filter layers, part of the phosphor layers and/or phosphors contained therein can be almost prevented from residing in the filter layers. In addition, after the filter layers are developed, the phosphors can be almost prevented from dropping out of the filter layers.

Moreover, in the method for forming a phosphor screen according to the present invention, since a silica layer containing fine particles of silica is formed by coating a colloidal silica solution on the pigment layers composing the filter layers, when the phosphor layers are removed from the filter layers, part of the phosphor layers and/or phosphors contained therein can be almost prevented from residing in the filter layer. In addition, after the filter layers are developed, the phosphors can be almost prevented from dropping out of the filter layers.

Furthermore, when the method for forming a phosphor screen according to the present invention is applied, a cathode ray tube, PDP, and so forth having phosphor screens with high contrast and high brightness can be fabricated without deterioration of uniformity property.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. A method for forming a phosphor screen, comprising the steps of:

forming a pigment layer on a substrate, the pigment layer containing a pigment and transmitting light with a predetermined wave length;

forming a silica layer containing silica on the pigment layer; and coating the silica layer with a phosphor layer containing phosphor.

2. The method as set forth in claim 1, wherein the silica layer forming step comprises the steps of:

coating a colloidal silica solution on the front surface of the pigment layer; and drying the coated colloidal silica solution.

3. A method for forming a phosphor screen, comprising the steps of:

forming a first pigment layer and a second pigment layer in a first area and a second area of a substrate, respectively, the first pigment layer containing a first pigment and transmitting light with a first wave length, the second pigment layer containing a second pigment and transmitting light with a second wave length;

forming a first silica layer and a second silica layer on the first pigment layer and the second pigment layer, respectively, the first silica layer and the second silica layer each containing silica;

coating the first silica layer with a first phosphor layer containing a first phosphor; and coating the second silica layer with a second phosphor layer containing a second phosphor.

4. The method as set forth in claim 2, wherein the first and second silica layer forming step comprises the steps of:

coating a colloidal silica solution on the front surfaces of the first and second pigment layers; and drying the coated colloidal silica solution.

5. The method as set forth in claim 2 or 4, wherein the particle diameter of the colloidal silica is 15 nm or less.

6. The method as set forth in claim 2 or 4, wherein the colloidal silica solution is acid.

7. The method as set forth in claim 2 or 4, wherein the colloidal silica solution has a pH of 2.0 to 5.0.

8. The method as set forth in claim 2 or 4, wherein the colloidal silica solution contain 0.2 to 5.0% by weight of silica.

9. The method as set forth in claim 3, wherein the peak of the wave length of the light that the first pigment layer transmits is different from the peak of the wave length of the light that the second pigment layer transmits.

10. The method as set forth in claim 2, wherein the phosphors contained in the first and second phosphor layers are selected corresponding to the wave lengths of light that the first and second pigment layers transmit.

11. The method as set forth in claim 2, wherein the phosphors contained in the first and second phosphor layers emit light with the same wave lengths of light that the first and second pigments transmit.

12. The method as set forth in claim 1, or 2, wherein the substrate is a face plate for a cathode ray tube.

* * * * *

UNITED STATES PATENT AND TRADEMARK OFFICE

CERTIFICATE OF CORRECTION

PATENT NO.: 5,922,395

DATED: July 13, 1999

INVENTOR(S): Koike et al.

It is certified that an error appears in the above-identified patent and that said Letters Patent is hereby corrected as shown below:

Claim 10, column 12, line 9, change "2" to --3--.

Claim 11, column 12, line 14, change "2" to --3--.

Claim 12, column 12, line 18, change "2" to --3--.

Signed and Sealed this

Eleventh Day of January, 2000

*Attest:*

Q. TODD DICKINSON

*Attesting Officer*

*Acting Commissioner of Patents and Trademarks*